United States Patent [19]

Leshner et al.

[11] 4,015,572

[45] Apr. 5, 1977

[54] CHARGE FORMING SYSTEM FOR INTERNAL COMBUSTION ENGINES

[75] Inventors: Ervin Leshner; Michael D. Leshner, both of Cherry Hill, N.J.

[73] Assignee: Fuel Injection Development Corporation, Bellmawr, N.J.

[22] Filed: Jan. 7, 1976

[21] Appl. No.: 647,326

[52] U.S. Cl. ..... 123/139 AW; 123/32 ST; 123/119 R; 123/139 BG; 261/50 A

[51] Int. Cl.[2] ..... F02M 7/18; F02B 17/00; F02B 3/02

[58] Field of Search ... 123/119 R, 139 BG, 139 AW, 123/32 ST, 140 MC, 325 P, 191 S, 140 MP, 32 EA, 119 EC, 32 ED; 261/50 A

[56] References Cited

UNITED STATES PATENTS

| | | | |
|---|---|---|---|
| 2,315,881 | 4/1943 | Thomas | 123/133 X |
| 2,330,650 | 9/1943 | Weiche | 261/50 |
| 2,399,077 | 4/1946 | Udale | 123/119 R X |
| 2,585,171 | 2/1952 | Pyle | 123/133 |
| 2,615,437 | 10/1952 | Broderson | 123/32 |
| 2,813,522 | 11/1957 | White et al. | 123/119 R |
| 2,841,130 | 7/1958 | Reggio | 123/140 MC X |
| 3,502,055 | 3/1970 | Beesch | 123/325 J |
| 3,713,630 | 1/1973 | Laprade | 123/119 R X |
| 3,789,816 | 2/1974 | Taplin et al. | 123/119 R |
| 3,906,909 | 9/1975 | Garcea | 123/97 B |
| 3,949,714 | 4/1976 | Mitchell | 123/140 MC X |

*Primary Examiner*—C. J. Husar
*Assistant Examiner*—Tony M. Argenbright
*Attorney, Agent, or Firm*—Woodcock Washburn Kurtz & Mackiewicz

[57] ABSTRACT

An improved charge forming system for an internal combustion engine. Fuel and air are metered to the engine as functions of both operator control and manifested engine power output. The incremental changes in fuel flow and air flow which are effected as a result of changes in engine power output are unequal so that the total fuel-air mix ingested by the engine becomes leaner as engine power increases. When the fuel-air mixture becomes so lean that engine power decreases, the charge forming system enriches the mixture so that the system maximizes engine power for any given rate of fuel flow. In a presently preferred embodiment the fuel-air ratio supplied to the engine is leaner than the stoichiometric mixture.

40 Claims, 6 Drawing Figures

CHARGE FORMING SYSTEM FOR INTERNAL COMBUSTION ENGINES

BACKGROUND OF THE INVENTION

The present invention relates to charge forming systems, and more particularly to an improved system for metering fuel to an internal combustion engine.

The past three quarters of a century have seen the development of the internal combustion engine evolve from a crude, erratic single cylinder prime mover into a multitude of engines spanning a vast array of sizes and types. Rotary, free-piston, in-line, opposed and radial designs are all in use. Practically every sort of valving arrangement has been implemented at one time or another; besides the dominant poppet valve, sleeve, rotary, swing and reed valves have all been used.

Although enormous energy and resources have been expended in exploring all of the conceivable mechanical configurations into which an internal combustion engine can be formed, such efforts are virtually dwarfed by the efforts which have been directed toward the development of a simple and economical charge forming system which will elicit near-maximum power from an engine, provide smooth operation at all combinations of speed and load conditions, give immediate throttle response and make efficient, economical use of fuel.

Unfortunately the latter desiderata are not all of the qualities which must be displayed by a practical charge forming system. The proper mixture must be provided whether the engine is hot or cold; and, if cold, an enrichment or "choking" of the engine must be provided for. The system must further be as simple as possible, and must be susceptible of economical manufacture. It must also be relatively trouble free and be serviceable by moderately trained personnel with the use of as little special equipment as possible.

Meeting these constraints has proved a continuing challenge to fully three generations of physicists, engineers, mechanics, craftsmen and tinkerers. Examples of systems which have been previously tried, and are generally related to the present approach are disclosed in many patents which have been issued over the years. For example, in U.S. Pat. No. 1,283,043-Battelle a carburetor is shown which feeds fuel as a function of both engine RPM and throttle position. U.S. Pat. Nos. 2,711,718-Spanjer and 2,585,171-Pyle show fuel metering systems of diverse sorts, although the Spanjer carburetor system is expressly designed for propane-type internal combustion engines.

Still other approaches have been tried; in U.S. Pat. No. 3,696,798 a fuel metering arrangement is shown which purports to manage fuel-air ratio through the use of a diaphragm-type controller which is responsive to air pressure on opposite sides of a throttle valve. Rice, in U.S. Pat. No. 3,825,239, discloses a complex system for controlling a fuel-air mixture by continuously sampling the mixture and burning it in a pair of sample jets. Electromechanical means within monitor flame characteristics and feed back appropriate signals to controlling apparatus. Still another approach is shown by Woods in U.S. Pat. No. 3,771,504 which comprises a fuel metering system executed using fluidic technology and in which throttle position is caused to vary as a function of metered fuel flow. In U.S. Pat. No. 3,596,643-Schweitzer there is shown an optimizing system for internal combustion engines that dithers engine parameters to detect a point of maximum RPM. While such a system is free of arbitrary, programmed characteristics it has inherent functional drawbacks.

Accordingly, it will be appreciated that many ingenious systems and components have been constructed, and after more than seven decades of effort charge forming systems for internal combustion engines have attained a high degree of development. However, new demands and constraints upon charge forming systems continue to be made. In particular, it is necessary to drastically lessen the amount of pollution emitted by internal combustion engines. The task of lessening the emissions from an internal combustion engine ultimately falls upon its charge forming system.

In an attempt to accommodate the latter-day, increasingly stringent requirements upon emissions from internal combustion engines scientists, engineers and others have been urged to new efforts to develop a superior charge forming system. The upshot has been a series of highly modified systems in which a conventional carburetion or fuel injection system is caused to operate in an extremely lean mode. The inadequacy of such modified systems is well known, fuel economy often suffering as a result of the modified system characteristics. The power and throttle response of production automobiles and trucks has also been detrimentally affected by the modifications.

In an effort to overcome the deficiencies of the modified systems newer, more complex systems have been developed. The latter systems are effectively "programmed", by the use of electronic circuits or otherwise, to synthesize signals for controlling the operation of an engine in response to perceived operating conditions in accordance with a predetermined scheme. The initial success of such systems, however, is dependent upon the ability of the system to synthesize the proper signals and the nature of the functional relationships within the system; their long-term success depends heavily upon the trouble-free operation of the complex system stages.

Accordingly, it will be appreciated that it would be desirable to provide a charge forming system for an internal combustion engine which provides smooth, responsive engine operation and minimizes both fuel consumption and the production of harmful pollutants.

It is therefore the object of the present invention to provide a self-calibrating charge forming system for an internal combustion engine.

It is another object of the invention to provide a charge forming system for an internal combustion engine which allows rapid response over a broad range of operation while maintaining the fuel-air ratio leaner than the stoichiometric ratio.

Another object of the invention is to provide an improved charge forming system in which the air-fuel ratio is controlled in response to manifested engine power output.

Still another object is to provide a fuel metering system which maintains an optimum fuel-air ratio over a broad range of engine operation.

Yet another object of the present invention is to provide a fuel and air metering system which meters fuel and air flow as a function of both a manual input and a manifestation of engine power.

Another object is to provide a metering system which continuously controls the fuel-air mix in response to a perceived manifestation of engine operation.

Another object of the present invention is to provide self-optimizing fuel and air flow controls adaptable for use with any lean burning stratified charge engine.

Still another object is to provide a charge forming system which is adaptable for use with a broad range of liquid fuels.

SUMMARY OF THE INVENTION

Briefly stated, in accordance with one aspect of the invention the foregoing objects are achieved by providing a charge forming system wherein both fuel and air flow are varied in the first instance by a manually controllable element. A manifestation of developed engine power is derived and applied through suitable transducing means to the charge forming system for decreasing the fuel-to-air ratio of the mixture ingested by an engine in response to an increase in developed power.

In a presently preferred embodiment a manifested increase in engine power is used to effect an increase of both fuel and air flow, the percent increase in air flow exceeding the percent increase in fuel flow. An enriched, igniting mixture is provided by vapor injecting and igniting means in each cylinder.

An air flow bias adjustment may be provided to the system to vary the effective range of the fuel-to-air ratio to be maintained, facilitating the use of diverse fuels. Further, a feedback loop may be added to the system to trim the adjustment range of the mechanism.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
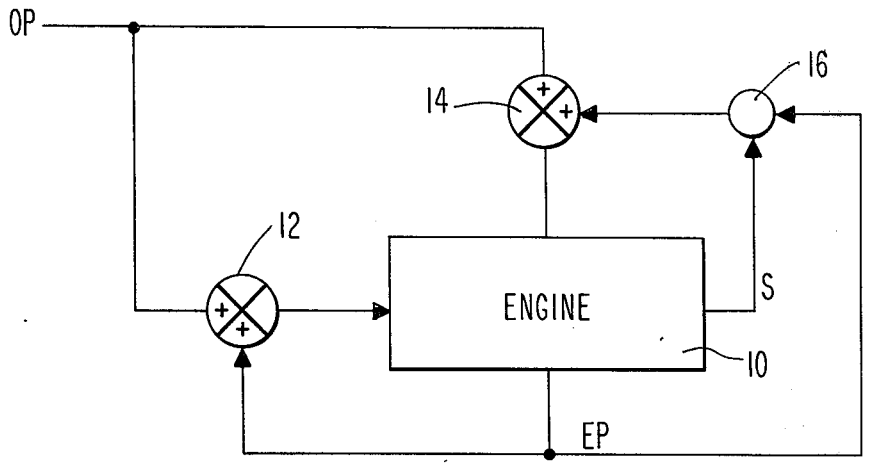
FIG. 1 is a functionalized diagram of a charge forming system embodying the teachings of the present invention.

FIG. 1 shows in simplified form a schematic diagram of one embodiment of a fuel metering system. A conventional spark ignited internal combustion engine 10 may be used with the embodiment shown, it being unnecessary to modify the engine in any way to adapt it for use with the system. The engine may then be a conventional automobile, truck or bus engine. In the preferred embodiment depicted engine power output, or more properly a manifestation thereof, is utilized along with operator control to meter both fuel and air to an engine. Engine 10 receives fuel in an amount which is determined by a metering device 12. The metering device is controlled as a function of both an operator input OP and a power signal EP which is derived from the engine. In a presently preferred embodiment the OP and EP inputs are summed so that the flow of fuel to the engine 10 is proportional to the algebraic combination of the two signals.

Air flow to the engine is similarly constrained to be a function of an operator input and engine power. In the presently preferred embodiment the effective operator input OP is applied to an air flow control mechanism 14 along with a signal EP, which comprises a manifestation of developed engine power. In this manner air flow may be considered proportional to the algebraic sum of OP and EP. The response of the fuel and air metering means to signal EP is such as to cause the air-to-fuel ratio to increase as engine power increases. A "trim" or adjustment capability may advantageously be included in the system to vary the range of the fuel-air ratio provided to engine 10. Such an adjustment is illustrated at 16 and may be considered to vary a factor controlling the air flow. The adjustment is intended to vary the range of the system to compensate for major variations in the specific heat of combustion of the fuel, as for instance if alcohol should be substituted for gasoline. Either alternatively or additionally adjustment 16 may be varied in response to a signal S derived from the engine. In this manner a feedback loop is established for maintaining the trim or basic range of the charge forming system. As will be demonstrated hereinafter adjustment 16 may also be disposed in the fuel flow system.

Figure 2:
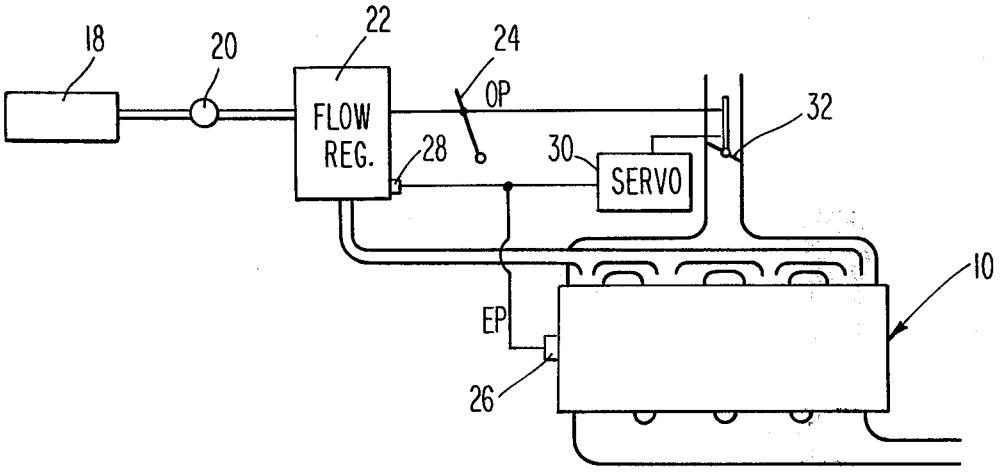
FIG. 2 is a schematic diagram of a preferred embodiment of the present invention.

Referring now to FIG. 2, there is shown in schematic form an elemental charge forming system which illustrates the basics of the presently preferred embodiment of the invention. A fuel reservoir 18 supplies liquid fuel by way of a pressure source such as pump 20 to a metering device, here shown as flow regulator 22. Since in most fluid systems fluid flow is a function of pressure, the regulator shown may conveniently comprise a pressure regulator of a known kind.

The operation of regulator 22 is controlled by two separate inputs. A first input, labeled OP in FIG. 1, comprises applied pressure arising in response to the movement of a manually controlled element such as foot pedal 24. The other input to the regulator is constituted by a manifestation of engine power EP. As will be understood by those skilled in the art engine power may be inferred in many ways. For instance engine torque might be derived by means of an appropriate transducer such as a strain gauge, and the resulting signal used to indicate engine power at a given engine RPM. Another approach might be to measure peak combustion pressure, or a time integral of overall combustion pressure for one or more engine revolutions at a given RPM. It is also contemplated that a conduit could be coupled to one or more engine combustion chambers and the pressure transmitted to a reservoir of hydraulic fluid. Fluid pressure could then be used to operate a throttle mechanism, the inertia of the system and/or appropriate damping means such as orifices functioning to integrate or average the pressure derived from the combustion chamber. Still other methods might encompass the mass rate of air flow through the engine, or exhaust temperature or back pressure. Yet other characteristics from which engine power may be inferred exist, and it should be understood that, given an understanding of the present invention one skilled in the art may derive the necessary information in any manner which is deemed convenient and economical to a given application.

In FIG. 2 a manifestation of engine power is derived by a receiving transducer 26 and transmitted to an output transducer 28 whereby the functioning of regulator 22 may be caused to vary in response to engine power. In a preferred embodiment the effects of engine power and operator control are additive, that is to say, the effect of moving pedal 24 in a direction to elicit added power from engine 10 is the same in sense as the effect upon regulator output of a perceived increase in engine power. Thus, fuel flow will increase as engine power increases.

It should here be noted that by "transducer" is meant any appropriate mechanism for deriving a desired manifestation and/or communicating or applying said manifestation to control apparatus for providing a desired result. Accordingly, it will be understood that transducers 36, 38 and 40 may be electrical, mechanical, hydraulic or pneumatic.

The manifestation of engine power is also delivered to an air flow control 30. The control is coupled to foot pedal 24 and a throttle 32 and serves to vary the throttle opening in response to movement of the foot pedal and/or to changes in engine power output. In a presently preferred embodiment, air control 30 acts to vary the opening of throttle 32 as a function of signal EP, by motive means included within the control. Thus the control 30 might respond to signal EP by compounding the effect of pedal displacement; by adding to the pressure exerted thereby upon the throttle mechanism; by operating upon the throttle separately, or in various other ways to effect an incremental increase in air flow. In the foregoing manner the ratio of air to fuel which is supplied to the engine is varied as a function of developed engine power. As was the case with fuel flow the correlation between changes in engine power and air flow is positive, i.e. as power increases, the degree of throttle opening also increases.

Of great importance to the preferred embodiment is the fact that the various elements of the systems are calibrated such that, for a given increase in engine power, the percentage increase in air flow which is effected is larger than the increase in fuel flow. Accordingly, for any given displacement of pedal 24 both fuel and air flow will achieve some nominal value due to the movement of throttle 32 and the displacement of elements within fuel regulator 22. The nominal value thus achieved is richer than the stoichiometric ratio. As a consequence of the pedal position, engine 10 is caused to produce a given amount of power. The increase in power then supports some increased fuel flow in addition to that demanded by the travel of pedal 24. In addition, the increase in engine power elicits further opening of throttle 32, the incremental opening of the throttle being greater than the incremental addition to fuel flow.

As a consequence of this activity, a leaner (higher air-to-fuel ratio) mixture is ingested by engine 10. If the mixture thus provided is optimum, herein mixture as the leanest possible mixture capable of producing a given quantum of power, the system will be in equilibrium. If the mixture becomes too lean, engine power will tend to diminish and accordingly air flow will be reduced at a faster rate than fuel flow resulting in enrichment of the mixture until the power level stabilizes at its maximum value for the amount of fuel then flowing. If, however, the mixture is still not the optimum engine power will be increased by the leaner mixture, causing the above-described activity to continue monotonically whereby air flow is increased at a faster rate than fuel flow until a point of minimum fuel flow for a given power level is attained. In the context of the present description this point is defined as the optimum operating condition for the engine.

The foregoing process, although characterized in step-by-step form for purposes of clarity, actually occurs in a swift continuous manner so that the optimum (i.e. the leanest possible) condition is attained quite rapidly. The stabilization of the mixture control may, for present purposes, be considered to be instantaneous inasmuch as the operator of a vehicle using such a system is not conscious of any progressive change or self-adjustment process.

Figure 3:
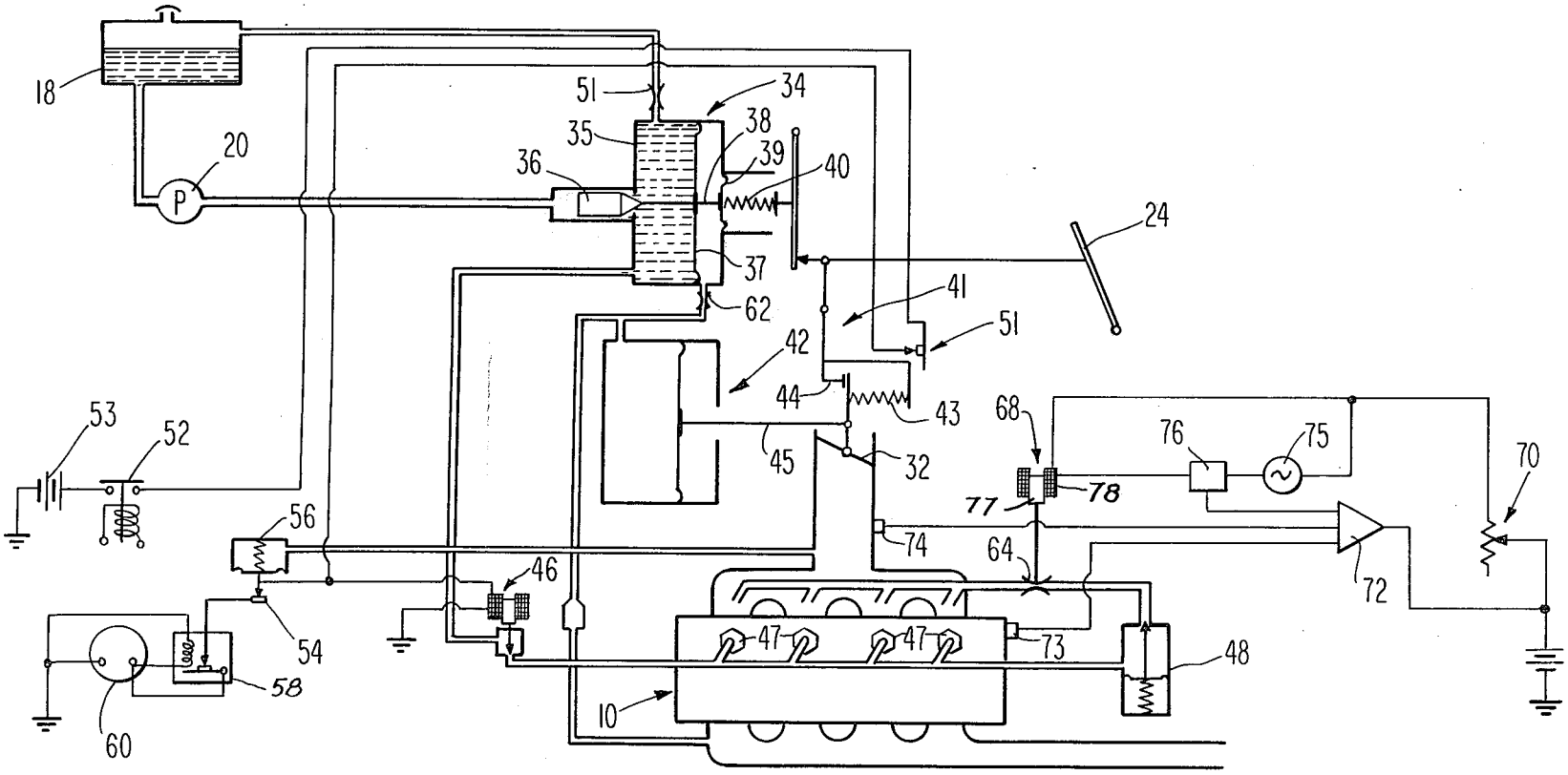
FIG. 3 is a schematic diagram showing a presently preferred implementation of the invention.

Turning now to FIG. 3, there is shown a complete system which comprises a presently-preferred implementation of the charge forming system set forth in FIGS. 1 and 2. As in FIG. 2 a reservoir or tank 18 is provided, along with a fuel pump 20 for developing an appropriate pressure in the fuel. The fuel is urged through a conduit to a regulator 34 which takes the form of a pressure regulator. As is familiar to workers in the art, such a pressure regulator comprises a housing 35 having an outlet and having an inlet aperture which is adjustably restricted by a metering needle 36. The liquid-confining portion of the housing is sealed at one end by means of a flexible diaphragm 37, through which is coupled a rigid link 38. In the depicted regulator a second chamber is defined by diaphragm 37 and by a second, smaller diaphragm 39. As will be described hereinafter the second chamber is pressurized in response to developed engine power. Pressure is applied to the second, smaller diaphragm 39 from a foot pedal 24 through a compressible spring 40. A small vent including a restriction 51 may be used to collect vapor bubbles from the fuel system and return them to the fuel reservoir.

The foot pedal is coupled to throttle 32 through a linkage 41. In a successully-tested embodiment the portion of the linkage coupling pedal 24 to the throttle is spring loaded as shown so that the throttle position may be advanced by the air flow control, here shown as a servo 42. The servo is operated by the source of the pressure which is applied to the fuel regulator, and which constitutes a manifestation of developed engine power. Spring 43 serves to bias the throttle toward a closed position which is limited by the linkage stop 44. Pressure within servo 42 urges a link 45, and thus throttle 32, in opposition to spring 43 to effect an increased throttle opening.

Fuel flows to the engine 10 by way of solenoid valve 46. In the preferred embodiment, the engine is equipped with fuel vapor injectors 47 of the type described in U.S. Pat. No. 3,926,169 issued Dec. 16, 1975 to E. Leshner. The injectors contemplated may thus comprise insertable members which are designed to replace the spark plugs of a conventional spark-ignited internal combustion engine, and are provided with passages for introducing and igniting a stream of vaporized fuel to ones of the cylinders. Liquid fuel may be supplied directly to the injectors, either subsequently or by means of a parallel conduit to the intake manifold of the engine. If desired, atomizing means such as nozzles may be used to facilitate the atomization of the fuel as it enters the engine manifold. The actual manner of delivery of the fuel does not, however, itself form a part of the present invention.

It has been found advantageous to include in the system a buffering or decoupling means 48 for isolating the pressure regulator 34 from the effects of changes in the manifold vacuum of the engine. An acceptable decoupling means may comprise a simple spring-loaded diaphragm valve of the type depicted which is biased so as to close the outlet aperture thereof when the output pressure drops below inlet pressure by a predetermined amount.

In a presently preferred embodiment the manifestation of developed engine power is exhaust back pressure. Accordingly, the exhaust manifold of engine 10 is tapped and the pressure developed therein coupled by means of an appropriate conduit through a vapor trap 49 to the fuel regulator 34 and air servo 42. The purpose of trap 49 is simply to collect condensate which may develop in the exhaust back pressure conduits.

As will be further described hereinafter, solenoid valve 46 is controlled by a circuit which includes a first leg coupled through contacts 50 of throttle switch 51 and starter switch 52 to a source of potential such as battery 53. A second circuit leg parallel to the first extends through contacts 54 of vacuum switch 56 to another voltage source, here the voltage regulator 58 which serves generator 60 and produces an electric potential only when engine 10 is operating. A restriction means 62 is disposed in the line which communicates exhaust gas back pressure to fuel metering device 34. Briefly, the purpose of the restriction is to afford a time lag between the operation of the fuel metering device 34 and air servo 42. In addition, another restriction 64 is disposed in the fuel conduit whereby a predetermined volume of fuel will flow to engine 10 in response to a given output pressure of regulator 34. By making restriction 64 replaceable its value can easily be varied so that the flow characteristics of the system can be readily adapted for use with different sized engines, or with fuel of different viscosities or having different heat energies. As will be discussed hereinafter, restriction 64 may be variable and controlled by automatic means.

Should it be necessary to extend the capability of the illustrated system beyond the limits of the particular elements utilized in a given implementation, a mixture control means such as solenoid 68 may be added to vary orifice 64. A potentiometer 70 affords a manual adjustment so that the system may be adjusted to accommodate various diverse fuels. Moreover, to provide close tracking or self-compensation, signals representative of engine operation may be provided the solenoid by way of an appropriate amplifier 72. In the embodiment of FIG. 3 a signal representing engine RPM or other appropriate parameter is produced by a first transducer 73 and a signal reflecting manifold pressure or other appropriate parameter by a second transducer 74, both of which transducers are coupled to amplifier 72. Other inputs such as pedal position, exhaust gas temperature, etc. may be substituted for the parameters used in FIG. 3, it being advisable that the input or inputs used to maintain the position of solenoid 68 be related to developed engine power.

As an additional refinement to the system under consideration, a source of alternating voltage 75 is provided in circuit with the windings of solenoid 68. Also in circuit with the windings is a detector 76 which is responsive to the alternating current component of the total current flowing through the windings. Detector 76, which may be any appropriate detector such as a capacitively-coupled rectifier, thus produces a signal voltage which is indicative of the degree of "ripple" or AC signal in the circuit. As is familiar to those skilled in the art, the degree of current ripple for a given, imposed AC voltage is dependent upon the overall reactance of the circuit. In the depicted circuit, the greater the inductance of solenoid 68, the more the impedance to fluctuations in current. As the core 77 of the solenoid is withdrawn from within the windings 78 the reactance of the solenoid diminishes, and the amount of ripple in the system current will increase. Similarly, as the throttle opens further core 77 will penetrate further within windings 78, raising the total inductive impedance of the solenoid and diminishing the effective current ripple. Thus, the output of detector 76 furnishes an indication of the position of core 77 within the solenoid. By feeding back this signal into amplifier 72, the position of the solenoid core may be caused to "track" a predetermined relationship with respect to the other signals. In effect, a separate feedback loop is established for dynamically correcting the desired position of the solenoid core throughout its operating range.

The operation of the system of FIG. 3 will now be described, making particular reference to the elements enumerated therein. When it is desired to start engine 10, the starting motor (not shown) is energized by battery 53 through an appropriate switch or solenoid. Coupled to the latter switch, or operable in concert therewith, is switch 52. Current now flows through normally-closed throttle switch 51 to the windings of the solenoid valve 46 to energize the latter, opening the valve and allowing fuel to flow to the engine in a volume determined by the position of pedal 24 and, accordingly, by regulator 34. The positioning of pedal 24 also determines the extent to which throttle 32 opens.

When the engine starts, a manifestation of delivered power (here exhaust back pressure) arises and adds to the effect of pedal 24 to increase fuel flow and, to a slightly greater extent, air flow. Under "no load" conditions, i.e. when the engine is not propelling a vehicle or operating under any significant load, the manifestation of delivered power is negligible and the fuel/air mixture is determined principally by the disposition of pedal 24.

It will be seen from FIG. 3 that after the engine is started and switch 52 opens, solenoid valve 46 will continue to be energized by current flowing from generator 60. Vacuum switch 56 is calibrated so that contacts 54 open under maximum manifold vacuum, that is, when engine 10 is rotating and throttle 32 is closed. This condition corresponds to the coasting or deceleration of a vehicle, in which case no fuel is needed. Accordingly, the illustrated system is operative to substantially cut off fuel flow when it is not needed, contributing to the economical operation of the engine and effectively overcoming a source of atmospheric pollutants.

While the engine is being cranked, fully depressing pedal 24 opens the contacts of switch 51 to de-energize the solenoid valve 46 and halt the flow of fuel to the engine. This allows an operator to clear a flooded engine, should that circumstance arise. As will be appreciated by those skilled in the art, the speed at which engine 10 is cranked is insufficient to allow generator 60 to produce sufficient current for energizing the solenoid valve 46.

As a load is placed upon engine 10, as for instance when a driven vehicle encounters a grade or is accelerated, the operator will depress pedal 24 to increase the fuel and air delivered to the engine and therefore the power which may be produced. In response to the increased power output the manifestation of developed power (exhaust back pressure) rises commensurately. The back pressure, when introduced to the area between diaphragms 37 and 39 of the fuel metering means exerts a greater total pressure on the larger diaphragm and urges metering needle 36 away from its orifice to effect an increase in the flow of fuel from regulator 34. At the same time the exhaust back pressure causes servo 42 to advance link 45 against the countervailing pressure of spring 43. This causes throttle 32 to open further than its nominal position, as originally determined by stop 44.

The percentage increase in throttle opening which is thus provided is greater than the percentage increase in fuel flow so that, as engine power rises, the air-to-fuel ratio increases (becomes leaner). The particular proportioning of the incremental increase in fuel flow and air flow is not believed critical to the practice of the present invention, and it is contemplated that the apportionment of such incremental changes will vary from one application to anotl.er. Accordingly, the teachings of the present invention extend to the diminution of fuel flow, at an unchanged throttle setting; or, alternatively, to an increase in throttle opening in the presence of substantially constant fuel flow; or a combination of the two approaches.

Accordingly, it will be appreciated by those skilled in the art that the goal to be achieved is the same in any case, i.e. to effect a leaner air-to-fuel mixture in response to increased engine power.

In the present embodiment, which comprises the best known mode of the invention, it is believed preferable to utilize a servomechanism in additive relationship to an operator input to achieve maximum fuel flow. This is because it is anticipated that, if fuel flow is under the total control of the operator, the engine may be flooded at low speeds by the sudden depression of pedal 24. Accordingly, it is presently believed that the best implementation of the system taught herein is one in which both air flow and fuel flow are increased, disproportionately, in response to an increase in engine power although it is within the purview of the present invention to increase only the net throttle opening in response to a manifested increase in engine power.

The foregoing activity is herein termed optimization and affords the leanest, and accordingly least polluting, operation of a given internal combustion engine system which is consistent with a given lever of power output. Further, the system taught herein continuously seeks the "optimum" mixture as long as the engine is in operation. The optimal condition is, in effect, defined by the engine itself so that no arbitrary or "programmed" constraints need be introduced into the operation of the engine and a relatively simple control system can result.

In order to insure that the system remains stable and does not "hunt" or oscillate about a stable condition, a restriction 62 or equivalent device may be provided. This causes increases or decreases in fuel flow, occurring in response to changes in engine power, to lag the operation of air servo 42. Accordingly, restriction 62 may restrict or delay changes in fuel flow which both increase and decrease; or, by using a one-way valve such as a flapper or reed valve, a lag may be introduced for either increasing or decreasing fuel flow conditions. It will accordingly be understood that in other executions of the system, whether they be pneumatic, hydraulic or electrical, an element analogous to restriction 62 may be provided as needed to effect the desired time lag.

As set forth above, a second servomechanism may under certain conditions be necessary to provide the system with enough flexibility to accommodate diverse fuels. To this end a mixture control servo 68 may be provided to vary the effective aperture of fuel line orifice 64 in accordance with the adjustment of a potentiometer 70 and/or the output of amplifier 72. A substantial diminution in developed engine power, as evinced by appropriate changes in the signals from transducers 73, 74 causes servo 68 to increase the effective opening of orifice 64, increasing the flow of fuel for a given output pressure of regulator 34 and thus enriching the fuel-air mixture. Conversely, an increase in engine power will cause the size of the orifice to be lessened.

From an examination of the Figure, it will now be seen that mixture control servo 68 in essence varies the fuel flow and accordingly the fuel-air ratio. Accordingly, it will be appreciated that other configurations or combinations of elements may be selected which will provide an equivalent response. As merely one example, a single servomechanism may be used in place of the two shown in the Figure, the single servo accommodating pneumatic, hydraulic and/or electrical inputs indicative of developed engine power and controlling throttle response over a range broad enough to encompass diverse liquid fuels.

Figure 4A:
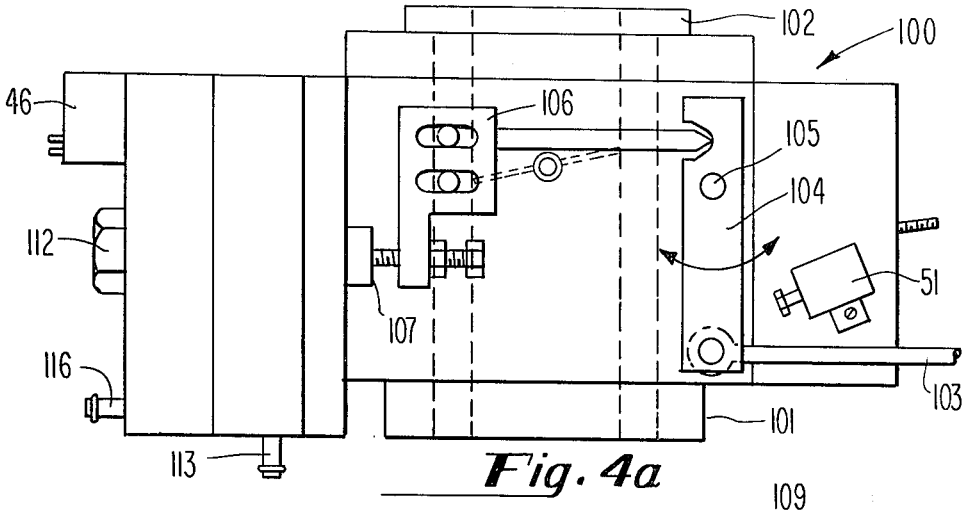
FIGS. 4*a*–4*c* are partially sectioned views of a control mechanism adapted for use with the invention.
Figure 4B:
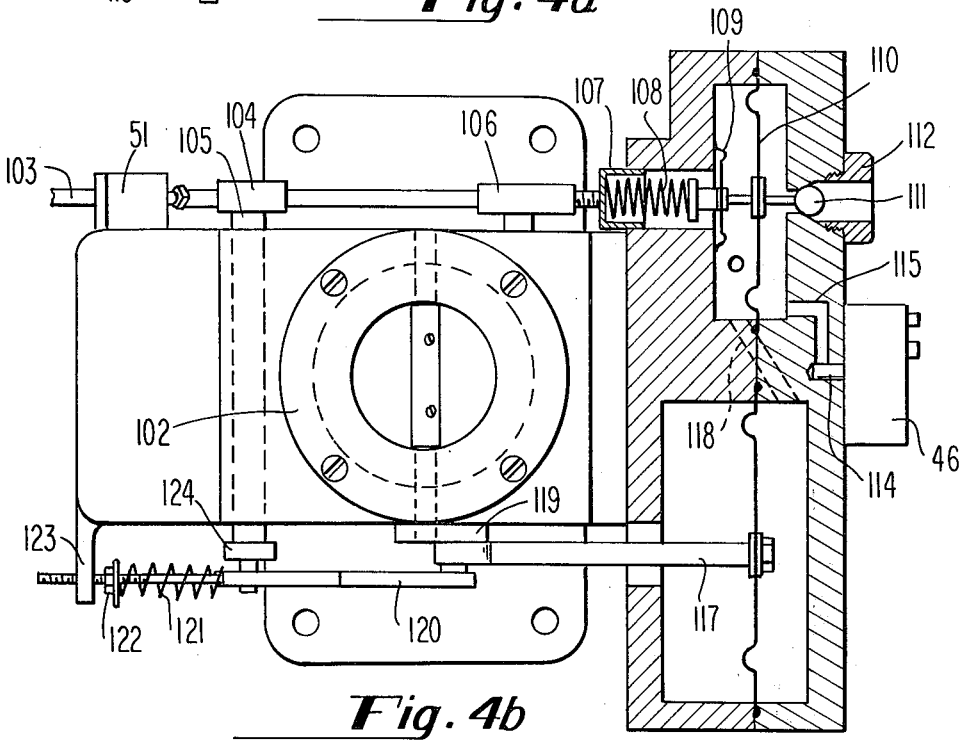
Figure 4C:
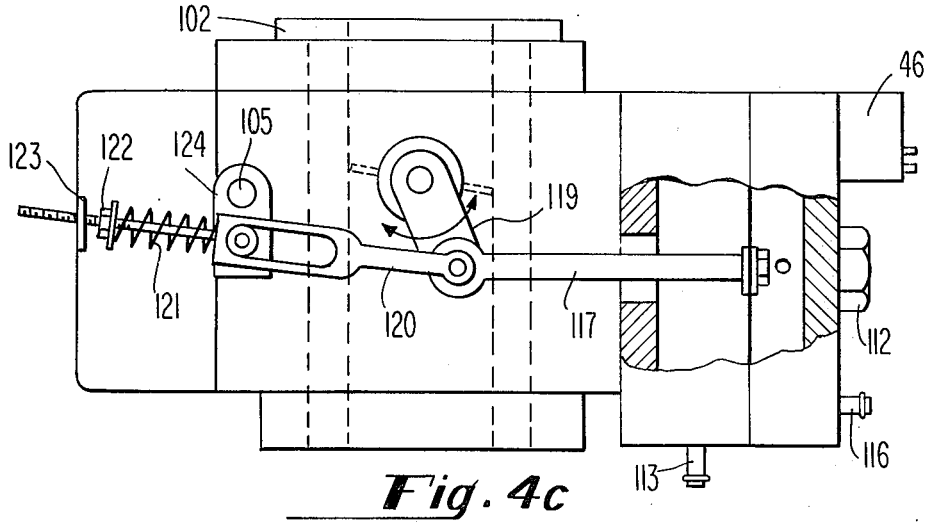

Turning now to FIGS. 4*a–c*, there is depicted a compact apparatus which embodies the fuel pressure regulator, air servo, and throttle linkages necessary for implementing the invention. The device comprises a body portion 100 having a base 101 provided with appropriate drilled holes for mating with the carburetor flange upon a conventional intake manifold. An upper flange 102 is provided for receiving an air cleaner, in the manner of a conventional carburetor. Accordingly, the illustrated device may be used to replace a carburetor in order to implement the conversion of existing vehicle power plants to the inventive system.

A rod 103 couples a foot pedal (not shown) to a link 104 pivotally disposed upon an axle 105. A sliding link 106 couples the pivot link 104 to an adjustable plunger 107 in the manner shown. Plunger 107 urges a spring 108 against a small, isolating diaphragm 109, as is depicted in FIG. 3. The smaller diaphragm is coupled through a larger diaphragm 110 by means of a push rod to a metering valve 111 which varies the effective size of an inlet orifice to the pressure regulator. A fitting 112, which may be selected from a variety of commonly-available fittings extends from the regulator housing to be coupled to a fuel line (not shown). The pressure chamber bounded by first and second diaphragms 109, 110 exits in a tube 113 which may be coupled through an appropriate vapor trap to the exhaust manifold of the engine, thus providing a manifestation of developed engine power.

FIG. 4*b* shows a top view of the apparatus of 4*a*, which has been further cut away to illustrate the construction of the unit. Solenoid valve 46 is attached to the casting, the plunger 114 thereof protruding within the casting in order to interrupt flow through an internal conduit generally designated at 115. The conduit extends transversely through the casting and exits in an appropriate outlet fitting 16.

The air servo is defined by a cavity disposed in the casting, and is coupled to external linkage by means of a push rod 117. An internal duct 118 serves to couple the air servo cavity to the area between the first and second diaphragms of the fuel metering system, so that pressure indicative of developed engine power may easily be communicated to the air servo.

As is best seen in FIG. 4*c*, the diaphragm of the air servo acts through push rod 117 upon throttle arm 119 which is biased through slotted rod 120 by a spring 121 carried on keeper rod 122. The end of the keeper rod may be supported in an appropriate guide 123, while the rod itself is positioned by an arm 124 coupled to axle 115. When arm 124 is rotated, the pressure on slider rod 120 causes the throttle to open or close.

As the diaphragm of the air servo moves, it urges arm 119 to rotate and open the throttle against the pressure of spring 121. The position, and thus the effective pressure of spring 121, is in turn determined by the attitude of arm 124. Accordingly, despite the fact that the operator-controlled foot pedal remains stationary the position of the throttle will be varied by the action of the air servo.

Finally switch 51, which serves to close solenoid valve 46 under full-throttle cranking conditions, is easily mounted to the slide of the housing through appropriate means, such as a screw. The switch is placed so that the end of throttle arm 104 will encounter the depressible plunger of the switch at an extreme of its travel.

It will now be seen that the control device shown in FIGS. 4*a*–4*c* comprises a compact system which can easily be substituted for prior art carburetors in converting internal combustion engines to implement the inventive system. Since fuel metering occurs independent of air flow no venturi or other restriction is necessary and the throat of the depicted unit may be cylindrical in form. If desired, liners of various internal diameters may be fitted within the unit and retained with simple clamping means to provide a throat of an appropriate size for a given engine.

As will be evident from the foregoing description, certain aspects of the invention are not limited to the particular details of the examples illustrated, and it is therefore contemplated that other modifications or applications will occur to those skilled in the art. It may for instance be feasible in certain applications to utilize a prior-art carburetor for supplying fuel to an engine, while an auxiliary air throttle mechanism is operated in response to manifested engine power to regulate the air-fuel ratio. Further, prior-art fuel injection systems may be adapted for use with the present invention to deliver either all or some proportion of the fuel requirements of the engine. It is accordingly intended that the appended claims shall cover all such modifications and applications as do not depart from the true spirit and scope of the invention.

What is claimed as new and desired to be secured by Letters Patent in the United States is:

1. A charge forming system for optimizing the air-to-fuel ratio of an internal combustion engine, comprising:
- control means for varying the flow of fuel and air to the engine;
- means adapted to be coupled to the engine for producing a manifestation of delivered engine power;
- servo means coupled to said control means for progressively monotonically altering the air-to-fuel ratio of the charge delivered to the engine in response to a manifested change in delivered engine power at least until said manifested change ceases.

2. A charge forming system as defined in claim 1 wherein said servo means comprises means for decreasing the air-to-fuel ratio of the charge in response to a manifested decrease in delivered engine power.

3. A charge forming system as defined in claim 1 wherein said servo means comprises means for increasing the air-to-fuel ratio of the charge in response to a manifested increase in delivered engine power.

4. A charge forming system as defined in claim 3 wherein said control means further comprises:
- fuel metering means responsive to movement of said manually displaceable means; and
- throttle means for variably restricting air flow to the engine.

5. A charge forming system as defined in claim 4 further including linkage means coupling said manually displaceable element to said fuel metering means and to said throttle means for effecting an increase in fuel flow and air flow pursuant to an incremental displacement of said manually displaceable element.

6. A charge forming system as defined in claim 4 wherein said servo means is coupled to said throttle means and is operative to decrease the restriction of air flow to the engine in response to a manifested increase in delivered engine power.

7. A charge forming system as defined in claim 6 wherein said fuel metering means comprises an enrichment stage coupled to said means for producing and operative to increase fuel flow in response to a manifested increase in delivered engine power.

8. A charge forming system as defined in claim 7 wherein the percentage increase in fuel flow produced by a given increase in engine power is less than the percentage increase in air flow produced thereby.

9. A charge forming system as defined in claim 8 wherein said linkage means comprises spring-biased means coupled to said manually displaceable element, and means coupled to said servo means for varying the incremental opening of said throttle against the pressure of said spring-biased means.

10. A charge forming system as defined in claim 8, further including fuel vapor injection means coupled to said fuel metering means and adapted to be disposed in fuel delivery relationship with the engine for providing an ignited richer-than-stoichiometric mixture in areas of each cylinder of the engine; and conduit means adapted to be coupled to the engine for delivering liquid fuel from said fuel metering means to the cylinders of the engine in a volume providing a leaner-than-stoichiometric mixture to each cylinder.

11. A charge forming system as defined in claim 9 further including biasing means coupled to said throttle for at least partially determining the response of said throttle to said servo means; and means for varying the value of said biasing means.

12. A charge forming system for causing an internal combustion engine to operate at the optimum condition over a range of operation, comprising:
- a manual control means;
- fuel metering means coupled to said manual control means for passing a controlled quantity of fuel to the engine;
- a throttle coupled to said manual control means for passing a controlled quantity of air to the engine;
- transducer means for producing a manifestation of a change in engine power;
- servo means for varying the ratio of air passing to the engine to the fuel passing thereto; and
- means coupling said servo to said transducer means for causing said servo to monotonically increase the ratio of air to fuel in the presence of a manifested increase in engine power, the increase in the ratio of air to fuel continuing at least until engine power ceases to increase.

13. A charge forming system as defined in claim 12 wherein said fuel metering means comprises a pressure regulator, and said means coupling said manual control means to said fuel metering means serves to apply pressure to said fuel metering means.

14. A charge forming system as defined in claim 13 further including fuel flow varying means coupled to said transducer means and responsive to manifested changes in engine power for applying pressure to said fuel metering means in conjunction with said manual control means.

15. A charge forming system as defined in claim 14 wherein said fuel flow varying means provides pressure additive to that of said manual control means for effecting an increase in fuel flow in response to an increase in manifested engine power.

16. A charge forming system as defined in claim 15 wherein said fuel flow varying means comprises first and second diaphragms disposed within said pressure regulator, said diaphragms being of differing effective areas for increasing the pressure outputted by said pressure regulator in response to an increase in pressure between said diaphragms.

17. A charge forming system as defined in claim 16 wherein said manifestation of engine power is exhaust back pressure.

18. A charge forming system as defined in claim 15 further including linkage means coupled to said servo means for effecting an opening of said throttle as a consequence of servo operation occasioned by an increase in manifested engine power.

19. A charge forming system for an internal combustion engine having intake and exhaust manifolds, and including throttle means associated with the intake manifold comprising:

a manually variable element;

metering means coupled to said manually variable element and responsive thereto for varying the rate at which liquid fuel and air are admitted to the engine;

means adapted to be coupled to the engine for developing a manifestation of delivered engine power and coupled to said metering means for applying said manifestation to said metering means;

said metering means being responsive to a manifested increase in developed engine power for progressively decreasing the fuel-to-air ratio of the charge admitted to the engine at least until the increase in developed power ceases.

20. A charge forming system as defined in claim 19 wherein said metering means is operative to increase the fuel-to-air ratio of the charge admitted to the engine in response to a manifested decrease in engine power.

21. A charge forming system as defined in claim 20 wherein said metering means comprises means responsive to a manifestation of developed engine power for diminishing the flow rate of liquid fuel to the engine.

22. A charge forming system as defined in claim 20 wherein said metering means comprises means responsive to said manifestation of developed engine power for increasing the flow rate of air to the engine.

23. A charge forming system as defined in claim 20 wherein said metering means comprises means responsive to a manifested increase in developed engine power for increasing the flow rate of both liquid fuel and air to the engine, the percentage increase in fuel flow being less than the percentage increase in air flow.

24. A charge forming system as defined in claim 23 wherein said metering means comprises a pressure regulator for metering liquid fuel.

25. A charge forming system as defined in claim 24 further including fuel injector means coupled to said pressure regulator and adapted to be coupled in fuel delivery relationship with the engine for providing cylinders of the engine with an easily ignitable enriched fuel mixture.

26. A charge forming system as defined in claim 25 further including means for varying the range of operation of said system for effecting substantially different fuel-to-air ratios in the presence of diverse liquid fuels.

27. A charge forming system for an internal combustion engine having intake and exhaust manifolds and having throttle means associated with said intake manifold, comprising:

means for developing a manifestation of a change in developed engine power;

a foot pedal;

a fuel flow regulator coupled to said pedal and to said means for developing for increasing fuel flow in response to a displacement of said pedal in a first direction and additionally or alternatively to an increase in developed engine power;

air flow control means coupled to said pedal for increasing air flow in response to a displacement of said pedal in a first direction;

said air flow control means further being coupled to said means for developing for monotonically increasing air flow in response to a manifested increase in developed engine power, the increase in air flow being proportionally greater than the resulting change in fuel flow, the increase in air flow continuing at least until the increase in developed engine power ceases;

whereby for a given position of said foot pedal an increase in developed engine power causes a leaner fuel mixture to be supplied to said engine.

28. A charge forming system as defined in claim 27 further including valve means for blocking fuel flow to the engine when the engine is not operating.

29. A charge forming system as defined in claim 28 further including valve means for blocking fuel flow to the engine when the engine is being cranked and said foot pedal is substantially fully depressed.

30. A charge forming system as defined in claim 29 wherein said fuel flow regulator is a pressure regulator including a metering valve and pressure-responsive means coupled to receive a first pressure from said pedal and operative to displace said valve, and further including means for developing a second pressure as a function of developed engine power and for applying said second pressure to said pressure-responsive means.

31. A charge forming system as defined in claim 30 wherein said manifestation of developed engine power is exhaust back pressure.

32. A charge forming system as defined in claim 31 further including buffering means adapted to be disposed between said fuel regulator and the engine for isolating the fuel flow regulator from changes in intake manifold pressure.

33. A charge forming system as defined in claim 32 further including fuel vapor injection and ignition means adapted to be operatively associated with each combustion region of the engine for providing an enriched, ignitable zone of fuel mixture in ones of the cylinders.

34. A charge forming system as defined in claim 33 further including means for varying the response of the throttle to said servo means to cause the system to provide a proper fuel-to-air ratio for disparate liquid fuels.

35. A charge forming system as defined in claim 34, wherein said air flow control means includes a servo coupled to the linkage between said pedal and the engine throttle and adapted to be coupled in operative relationship with the exhaust stream of the engine and thereto for monotonically varying throttle opening.

36. A charge forming system as defined in claim 35 further including second means for developing a manifestation of developed engine power for controlling said means for varying in order to provide a substantially constant fuel-to-air ratio over a broad range of engine operation.

37. A charge forming apparatus for an internal combustion engine having intake and exhaust manifolds comprising:

a housing having a base adapted to be coupled to the mounting flange of the intake manifold of the combustion engine, and including a bore for admitting air and a throttle for variably restricting said bore;

said housing defining a first cavity for receiving liquid fuel, said cavity including an inlet and an outlet;

duct means communicating with the outlet of said first cavity for passing liquid fuel from said first cavity to the bore of the housing;

means for variably restricting said inlet of said first cavity;

a linkage coupled to said throttle and to said means for variably restricting the cavity inlet to provide simultaneous increases in fuel and air flow to an engine;

said housing defining a second cavity for receiving a manifestation of engine power, and including pressure responsive means coupled to said linkage for monotonically increasing throttle opening only in the presence of an increase in developed engine power.

38. A charge forming apparatus according to claim 37 further including a first and a second diaphragm disposed in said first cavity for partitioning said cavity into first and second zones, said first zone encompassing said fuel inlet and outlet; and means coupling said second zone to said second cavity for applying a manifestation of developed engine power thereto.

39. A charge forming apparatus according to claim 38 further including electrical switch means mounted thereon in proximity to said linkage for operating a remotely-located valve to terminate fuel flow when said throttle is substantially fully open and the engine is inoperative.

40. A charge forming apparatus as defined in claim 39 wherein said bores are comprised of replaceable sleeves having different cross-sectional areas whereby the air flow characteristic of said apparatus may be varied by substituting said replaceable bores.

* * * * *